United States Patent [19]

Fujiki et al.

[11] Patent Number: 4,535,581

[45] Date of Patent: Aug. 20, 1985

[54] METHOD OF HEAT-INSULATING AND WATER-PROOF CONSTRUCTION UTILIZING A ROLL HAVING A WEB PORTION AND A FLAP PORTION

[75] Inventors: Toshiaki Fujiki; Hikaru Kano, both of Hyogo, Japan

[73] Assignee: Mitsuboshi Belting Ltd., Hyogo, Japan

[21] Appl. No.: 495,326

[22] Filed: May 17, 1983

Related U.S. Application Data

[63] Continuation-in-part of Ser. No. 321,012, Nov. 13, 1981, Pat. No. 4,443,993.

[51] Int. Cl.[3] ..... E04D 1/28

[52] U.S. Cl. ..... 52/746; 52/520

[58] Field of Search ..... 52/520, 589, 462, 746

[56] References Cited

U.S. PATENT DOCUMENTS

| | | | |
|---|---|---|---|
| 433,500 | 8/1890 | Walbridge | 52/589 |
| 1,710,413 | 4/1929 | Evans | 52/462 |
| 2,225,921 | 12/1940 | Murdock et al. | 206/412 |
| 2,715,596 | 8/1955 | Hawley | 206/389 |
| 3,692,176 | 9/1972 | Templeton et al. | 206/389 |
| 4,443,993 | 4/1984 | Fujiki et al. | 52/520 |

FOREIGN PATENT DOCUMENTS

| | | | |
|---|---|---|---|
| 775377 | 5/1957 | United Kingdom | 206/412 |

*Primary Examiner*—James L. Ridgill, Jr.

*Attorney, Agent, or Firm*—Sughrue, Mion, Zinn, Macpeak & Seas

[57] ABSTRACT

A method of constructing a heat-insulating and water-proof structure by employing a plurality of heat-insulating members utilizes a water-proof membrane which includes a plurality of membrane sections which are connected together and provided in a roll form. A first water-proof membrane section is placed over a heat-insulating member, and one longitudinal edge of the water-proof membrane section is bent about one longitudinal edge of the heat-insulating member and secured to a base surface. A second heat-insulating member is then laid on the base surface next to the first heat-insulating member so that the one longitudinal edge of the first water-proof membrane section is held between the first and second heat-insulating members. A second water-proof membrane section is placed over the second member, and one longitudinal edge of the second membrane section is bent and secured to the base surface, and this process is continued until the entire heat-insulating and water-proof structure is constructed.

7 Claims, 7 Drawing Figures

METHOD OF HEAT-INSULATING AND WATER-PROOF CONSTRUCTION UTILIZING A ROLL HAVING A WEB PORTION AND A FLAP PORTION

CROSS-REFERENCES TO RELATED APPLICATIONS

The present invention is a continuation-in-part of application Ser. No. 321,012 filed Nov. 13, 1981, now U.S. Pat. No. 4,443,993.

BACKGROUND OF THE INVENTION

1. Field of the Invention

This invention relates to a method of constructing a heat-insulating and water-proof structure. More particularly, it is concerned with a method of constructing a heat-insulating and water-proof structure by laying, but not securing, a plurality of heat-insulating boards on a base surface, and by joining a plurality of water-proof membrane sections to one another so that each membrane section covers one of the heat-insulating boards.

2. Description of the Prior Art

A lot of heat-insulating and water-proof structures have been developed since lightweight roofing slabs became available. For example, it is well known to attach heat-insulating material, in the form of foamed polyethylene or polyurethane membranes, to roofing slabs with an adhesive, and securing a large water-proof membrane to the insulating material with an adhesive. The adhesive is employed on both sides of the heat-insulating material. This method involves a number of drawbacks which cannot be avoided unless a high level of skill is employed in construction work. The water-proof membrane wrinkles and swells easily when using the adhesive. In addition, specks of the adhesive formed when it is applied or dries makes it difficult for the water-proof membrane to adhere uniformly to the heat-insulating material.

In order to improve these drawbacks, there has been developed a fastening method which does not employ any adhesive. According to this method, a water-proof sheet is secured to a heat-insulating material by fastening means such as screws, nails, rubber members or holding bars. The heat-insulating material is secured to a roof deck, and the fastening means are covered with rubber strips or membranes. Although this method has overcome the drawbacks which are caused by the adhesive, it still has a number of other drawbacks. Those portions of the water-proof membrane which are secured by the fastening means to the heat-insulating material are likely to be pulled away from the heat-insulating material by wind pressure or other external forces. As a result, these forces, in conjunction with the fastening means, subject the water-proof membrane to high stresses, and the water-proof membrane is easily torn by the fastening means which secure it to the heat-insulating material. Moreover, the fastening means and the rubber strips or membranes covering them, protrude from the water-proof sheet and impair the appearance of the structure. Furthermore, it is impossible to remove any wrinkle that has formed in the water-proof membrane.

SUMMARY OF THE INVENTION

It is an object of this invention to provide a novel and improved method of constructing a heat-insulating and water-proof structure which eliminates the aforesaid drawbacks of the prior art. The method of this invention is intended for firmly securing water-proof membranes covering heat-insulating materials, improving the appearance of the water-proof membranes in the areas where they are secured, preventing formation of any crease in the water-proof membranes, and providing the water-proof membranes with a smooth surface finish which presents a fine appearance. In addition, the method of the invention is intended to allow even an amateur with little construction skill to perform insulation work easily and quickly.

According to the present invention, there is provided a method of heat-insulating and water-proof construction which comprises the steps of placing a heat-insulating member on a base surface, placing a water-proof membrane on the heat-insulating member so that the water-proof membrane covers the heat-insulating member and has one longitudinal edge terminating between an adjoining heat-insulating member and the base surface so that the adjoining heat-insulating member is free from the base surface, the water-proof membrane being free from the heat-insulating member, securing the one longitudinal edge of the water-proof membrane to the base surface, and joining the other longitudinal edge of the water-proof membrane to an upper surface of an adjoining water-proof membrane so that all of the water-proof membranes may be joined to one another by repeating these steps using additional water-proof membranes and heat-insulating members.

A further feature of the present invention comprises the step of forming the water-proof membrane so that it has a web portion and a plurality of flat portions in such a manner that the water-proof membrane can be wound into a roll. According to one embodiment of the present invention, a plurality of water-proof membrane sections, each comprising a flap portion in a flat portion, are integrally joined together and rolled up into a roll, whereas in another embodiment of the present invention, a plurality of independently cut flaps are joined on an integral web portion of the membrane so that the flaps are equal distances from one another, and subsequently the web portion having flaps attached thereto is rolled up into a roll.

DESCRIPTION OF THE PREFERRED EMBODIMENTS

Figure 1:
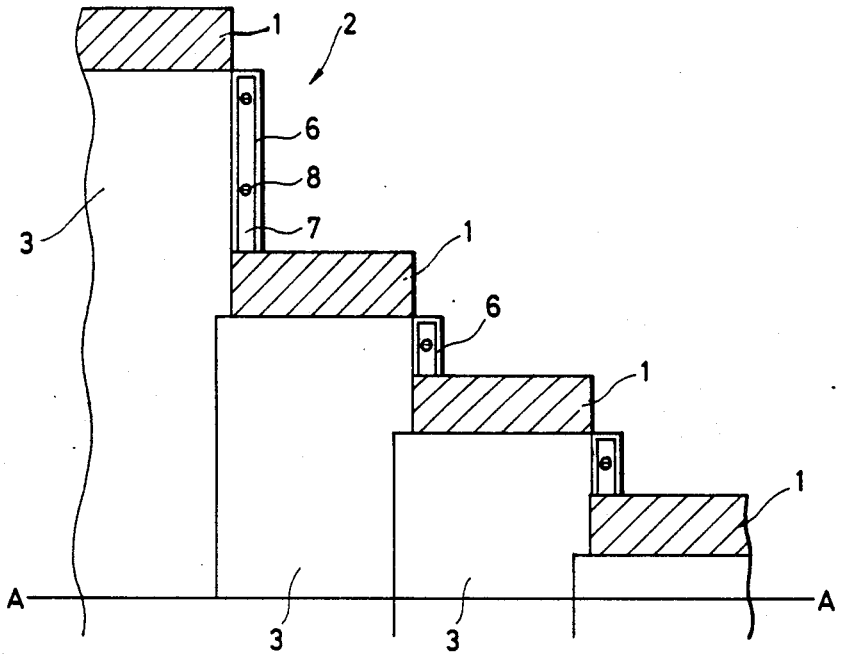
FIG. 1 is a fragmentary top plan view of a heat-insulating and water-proof structure constructed by a method embodying this invention.
Figure 2:
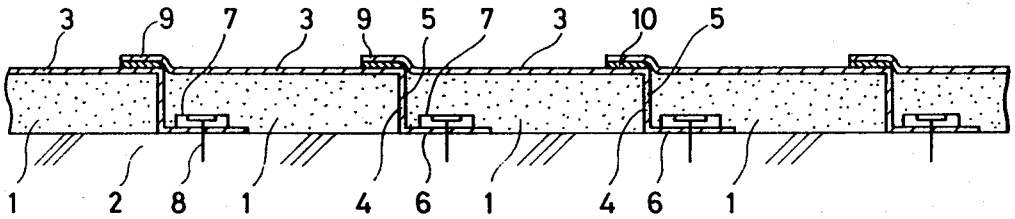
FIG. 2 is a sectional view taken along line 2—2 of FIG. 1.

Referring first to FIGS. 1 and 2 of the drawings, there is fragmentarily shown a heat-insulating and water-proof structure constructed by a method embodying this invention. A heat-insulating member 1 is laid on a horizontal or inclined base surface 2. The heat-insulating member 1 comprises a membrane of foamed polystyrene, polyethylene or polyurethane, a fiber board, or a composite thereof having a width of 900 to 2,400 mm and a thickness of 12 to 80 mm. The heat-insulating member 1 is not joined to the base surface 2. A water-proof membrane 3 is placed on the heat-insulating member 1 and not joined thereto. The waterproof membrane 3 comprises, for example, a vulcanized sheet of rubber, such as ethylenepropylene terpolymer, butyl rubber, or a mixture thereof. One longitudinal edge portion 4 of the waterproof membrane 3 is bent along one side 5 of the heat-insulating member 1, but not joined thereto. The longitudinal edge portion 4 has a width of at least 50 mm. It is bent again in an L-shaped pattern as shown at reference numeral 6, and secured to the base surface 2. If the base surface 2 is composed of concrete, the water-proof membrane 3 is secured thereto with an adhesive. If it is made of wood or steel, the waterproof membrane 3 can be secured thereto quickly and rigidly if fastening members 8, such as screws or nails, are employed. In this case, an auxiliary fastening member 7 is applied to the longitudinal edge 6 of the water-proof membrane 3. The auxiliary fastening member 7 may comprise a holding bar or batten of a metal or resin, or a strip of rubber.

A second heat-insulating member 1, which is equal in thickness to the first heat-insulating member 1, is placed on the base surface 2, so that it may cover the longitudinal edge 6 of the first water-proof membrane 3. The longitudinal edge portion 4 of the first water-proof membrane 3 is thus held between the two heat-insulating members 1. A second water-proof membrane 3 is placed on the second heat-insulating member 1, and one longitudinal edge portion 4 thereof is bent along one side 5 of the second heat-insulating member 1, and secured to the base surface 2 by another auxiliary fastening member 7 and fastening member 8, exactly in the same manner as herein above described. This sequence of work is repeated until a predetermined number of heat-insulating members 1 are laid on the base surface 2, and a corresponding number of water-proof membranes 3 are placed thereon, and secured to the base surface 2.

The other longitudinal edge 9 of each water-proof membrane 3, which may have a width of 50 to 100 mm, is joined to an adjoining water-proof membrane 3 with an adhesive tape 10 of, for example, the self-curing curable type. Thus, the water-proof sheets divide the heat-insulating members from one another, and are joined to one another on the heat-insulating members. This arrangement eliminates the necessity of joining the heat-insulated members to the base surface and the water-proof membranes with an adhesive, and yet ensures that the heat-insulating members are firmly held by the water-proof membranes, since one longitudinal edge of each water-proof membrane is firmly secured by the fastening members, while the other longitudinal edge of such water-proof membrane is joined to the adjoining water-proof membrane.

The foregoing description is an embodiment in which each water-proof membrane covers one heat-insulating member. This invention is, however, not limited to such an arrangement and is also applicable to other cases in which each water-proof membrane covers two or more heat-insulating members.

Figure 3:
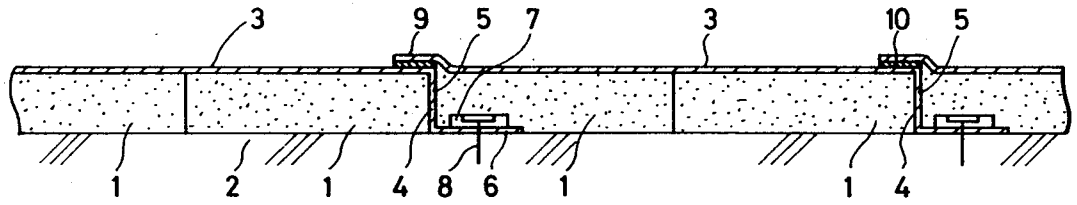
FIG. 3 is a view similar to FIG. 2, but showing a modified form of construction according to the method of this invention.

Referring, therefore, to FIG. 3, there is shown a modified arrangement in which each water-proof membrane covers two heat-insulating members. Two heat-insulating members 1 are placed longitudinally close to each other, and covered by a water-proof membrane 3 having a width which is sufficient to cover the combined width of the two heat-insulating members. One longitudinal edge 6 of each water-proof membrane 3 is secured to the base surface 2 by an auxiliary fastening member 7 and a fastening member 8, while the other longitudinal edge 9 thereof is joined to an adjoining water-proof membrane 3, as hereinbefore described. The arrangement of FIG. 3 reduces the number of the water-proof membranes which are required, and therefore, the time and labor required for securing and joining the longitudinal edges of the water-proof membranes. This means a reduction in the time required for construction.

Figure 4:
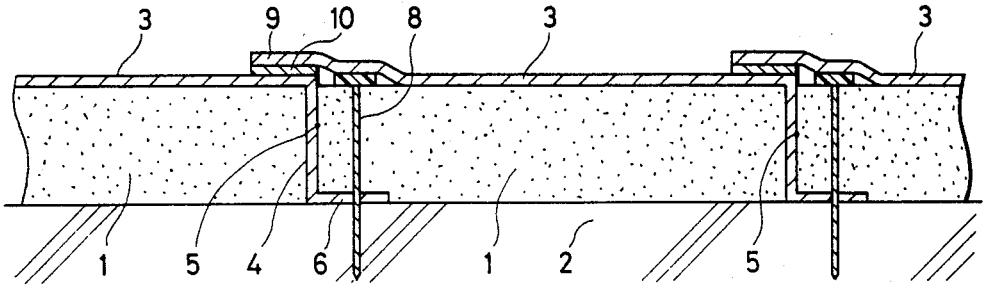
FIG. 4 is a view similar to FIG. 2, but showing a still different form of construction according to the method of this invention.

Referring now to FIG. 4, there is shown a still different form of construction. A heat-insulating member 1 is laid on the base surface 2, but not joined thereto. A water-proof membrane 3 is placed on the heat-insulating member 1, but not joined thereto. One longitudinal edge portion 4 of the waterproof membrane 3 is bent along one side 5 of the heat-insulating member 1 and not joined thereto, but is bent again in an L-shaped pattern as shown at 6. The longitudinal edge 6 is not secured to the base surface 2. A second heat-insulating member 1 is laid on the base surface 2 and the longitudinal edge 6 of the first water-proof membrane 3, whereby the longitudinal edge portion 4 of the water-proof membrane 3 is held between the two heat-insulating members 1. Fastening members 8, such as nails or screws, are driven through the second heat-insulating member 1 adjacent to an edge thereof, and through the longitudinal edge 6 of the first water-proof membrane 3 to secure the second heat-insulating member 1 and the first water-proof sheet 3 to the base surface 2. This sequence of work is repeated until a predetermined number of heat-insulating members are laid, and a corresponding number of water-proof membranes are applied thereto. Then, the other longitudinal edge 9 of each water-proof membrane 3 is joined to an adjoining membrane 3 by an adhesive tape 10, whereby all the water-proof membranes 3 are joined to one another, as hereinbefore described.

Figure 5:
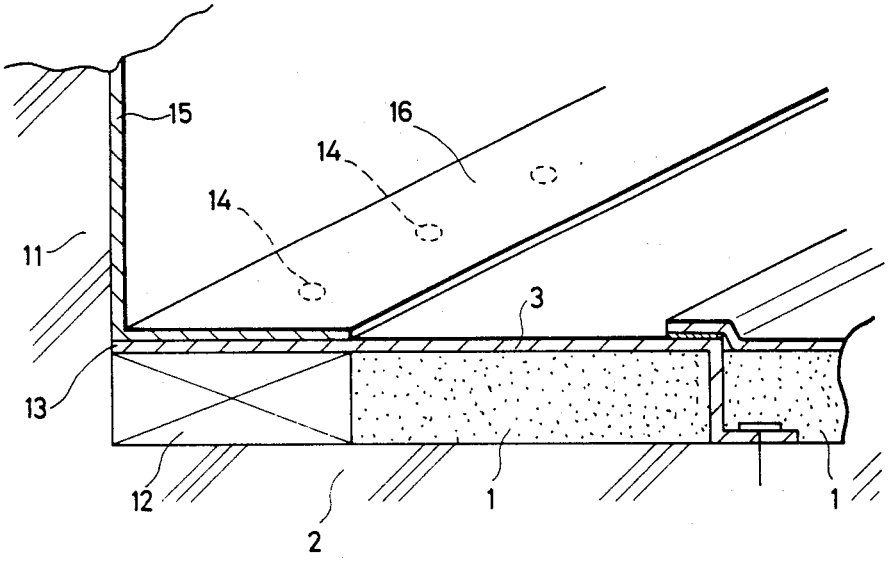
FIG. 5 is a fragmentary perspective view showing an edge of the structure constructed by the method of this invention.

Attention is now directed to FIG. 5 showing a mode of construction at an edge of a structure constructed according to the method of this invention. More specifically, FIG. 5 shows an arrangement involving an upright wall 11 which is perpendicular to a base surface 2. A wooden auxiliary member 12 is placed in contact with the upright wall 11, and a first heat-insulating member 1 is laid in contact with the wooden member 12. A water-proof sheet 3 is placed on the wooden member 12 and the heat-insulating member 1. One longitudinal edge 13 of the water-proof sheet 3 is bent and secured to the base surface 2 as hereinbefore described. The other longitudinal edge of the water-proof sheet 3 is placed in contact with the upright wall 11. Fastening members 14, such as screws or nails, are driven through the water-proof sheet 3 and the wooden member 12 to secure the water-proof sheet 3 to the wooden member 12. Then, a water-proof sheet 15 is secured to the upright wall 11, and its lower edge portion 16 is bent horizontally, and joined to the water-proof membrane 3 on the wooden member 12 with an adhesive or adhesive tape. A similar mode of work may be employed for finishing construction at the opposite edge of the base surface.

According to the above-described embodiments, one longitudinal edge portion 4 of each of the water-proof membranes 3 is secured by the longitudinal sides 5 of adjacent heat-insulating members 1, and the longitudinal edge 6 of each edge portion 4 is folded into an L-shape and is secured to the base surface 2 while simultaneously being positioned below a lower surface of an adjacent heat-insulating member 1. In addition, the other edge portion 9 of each water-proof membrane 3 is placed over an adjoining water-proof membrane 3 so that the outer edge portion 9 does not directly contact a heat-insulating member 1. According to these embodiments, the heat-insulating members 1 are petitioned into blocks by the individually formed water-proof membranes 3. Accordingly, it is necessary to individually form each of the water-proof membranes 3 and package them in stacks for use in constructing a heat-insulating and water-proof structure.

Figure 6:
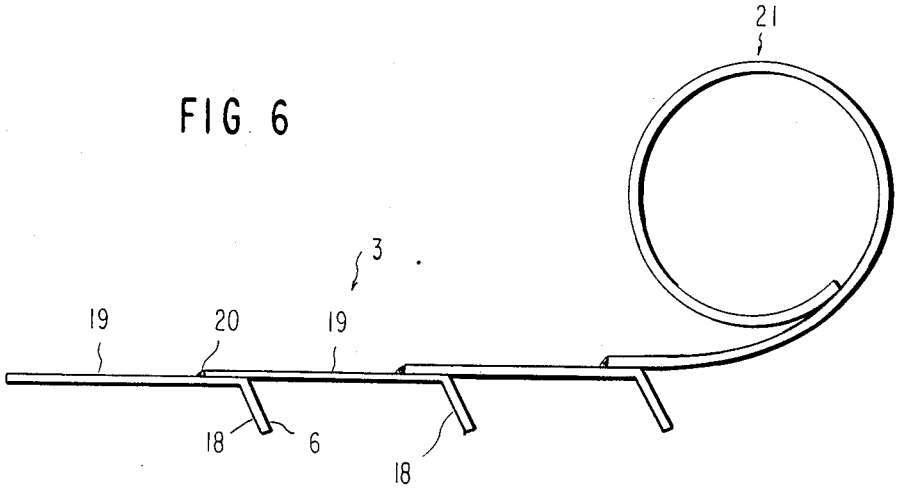
FIG. 6 is a side view of a water-proof membrane constructed in roll form for use with the method of the present invention.
Figure 7:
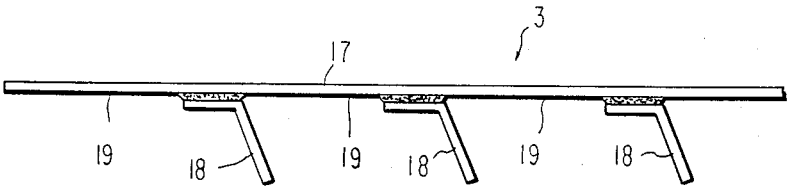
FIG. 7 is a side view of another water-proof membrane construction for use with the method of the present invention.

On the other hand, according to the additional embodiments shown in FIGS. 6 and 7, a continuous water-proof membrane 3 is prepared and rolled into a roll to facilitate the construction of the heat-insulating and water-proof structure. Referring specifically to the embodiment shown in FIG. 6, the continuous water-proof membrane 3 comprises a plurality of sections 19 which each include an integral flat portion 20 and a flap portion 18. Each flat portion 20 of each section 19 is joined to an intermediate section of the flap portion 18 of an adjacent section 19. Accordingly, all of the individual sections are integrally joined together so that the water-proof membrane can be formed and wound into a roll at a factory. To utilize the water-proof membrane 3 shown in FIG. 6 in the method of the present invention, the flap portion 18 is placed along an edge 5 of one of the heat-insulating members 1, and subsequently the flap 18 is folded or bent into the above-described L-shape so that an outer edge 6 of the flap portion 18 can be fixed to the base surface. The procedure used for fixing the edge 6 of the flap portion 18 to the base surface is the same as described above in the discussion of the embodiments of FIGS. 1–5. In other words, to construct a heat-insulating and water-proof structure utilizing a roll 21 as shown in FIG. 6, a first heat-insulating member 1 is laid on the base surface 2, and subsequently a first section 19 of the water-proof membrane 3 is laid over an upper surface of the first insulating member 1 in such a manner that the upper surface of the insulating member 1 is aligned with the flat web portion 20 without using adhesive materials. Next, the flap 18 is folded or bent along one vertical side of the first insulating member, and the edge of the flap 18 is further folded into an L-shape so that the outer portion 6 of the flap 18 can be fixed to the base surface 2 by using the fixing means described in the discussion of the embodiments of FIGS. 1–5. Thereafter, a second heat-insulating member 1 having a thickness which is identical to the first insulating member 1 is placed on the base surface 2 so as to be positioned over the L-shaped folded flap 18 so that the sides 5 of the first and second heat-insulating members 1 support the flap. Subsequently, a second section 19 of the water-proof membrane 3 is placed over the second heat-insulating member 1, and the flap 18 of the second membrane 3 is folded along a vertical side of the second insulating member and then further folded into an L-shape in the same manner as described above so that a third heat-insulating member 1 can be placed over this additional L-shaped folded flap 18. This process is continuously repeated with additional water-proof membrane sections 19 being easily supplied by simply unwinding the roll 21.

In the embodiment of FIG. 7, the water-proof membrane 3 is formed by securing a plurality of independently cut flaps 18 onto a lower surface of a continuous integral web membrane 17 so that the flaps 18 are equidistantly spaced from one another. Subsequently, the membrane 3 is wound into a roll in a manner similar to that shown in FIG. 6. The method of utilizing the membrane 3 shown in FIG. 7 in constructing a heat-insulating and water-proof structure is the same as described above in the discussion of using the roll 21 shown in FIG. 6.

According to the additional embodiments of the present invention shown in FIGS. 6 and 7, even an amateur can construct a heat-insulating and water-proof structure easily and quickly since the water-proof membrane 3 in the form of the roll 21 allows the membrane 3 to be successfully applied over a plurality of heat-insulating members 1 without trouble since successive sections 19 of the membrane 3 are easily supplied by unwinding the roll 21.

According to the method of this invention, the heat-insulating members are not joined to the base surface or to the water-proof membranes with an adhesive. Rather, one longitudinal edge of each water-proof membrane is secured to the base surface, while the other longitudinal edge thereof is joined to an adjoining water-proof membrane, as hereinabove described in detail. The water-proof membranes covering the heat-insulating members are secured firmly. Since no nails or other fastening members are used for securing the water-proof membranes directly to the heat-insulating members, the water-proof membranes can be protected against damage in the areas where they are secured, and the water-proof membranes provide a smooth surface and a fine appearance to a heat-insulating and water-proof structure. As the structure is composed of a plurality of heat-insulating members divided from one another by water-proof membranes, it is possible to use water-proof membranes having a relatively small width, and therefore prevent formation of wrinkles in the water-proof membranes. Since each heat-insulating member, or each group of heat-insulating members, is sealed by a water-proof membrane, it is possible to prevent any water from migrating from one heat-insulating member to another, or from one group of heat-insulating members to another.

We claim:

1. A method of constructing a heat-insulating and water-proof structure, comprising the steps of:

forming a water-proof membrane having a flat web portion and a plurality of flap portions by connecting a plurality of water-proof membrane sections together, each membrane section comprising a flat portion and a flap portion integral therewith wherein adjacent first and second membrane sections are connected by connecting a lower surface of the flat portion of the second adjacent membrane section with an upper surface of the flap portion of the first adjacent membrane section;

laying at least one first heat-insulating member on a base surface;

placing said water-proof membrane on said at least one first heat-insulating member so as to align said web portion therewith;

bending a flap portion along an edge of said first insulating member;

placing an edge of said flap portion on said base surface; and laying a second heat-insulating member on said base surface so as to position an edge portion of said second heat-insulating member on said edge of said flap portion.

2. The method as claimed in claim 1, wherein said flap portion is supported between confronting side surfaces of said first and second heat-insulating members.

3. The method as claimed in claim 1, wherein said bent flap portion is L-shaped.

4. The method as claimed in claim 1, wherein said forming step comprises the steps of preparing an integral web portion and joining independently cut flaps to said web portion at equal distances from one another.

5. The method as claimed in claim 4, wherein said forming step further comprises the step of rolling said web portion having said joined cut flaps thereon in a roll.

6. The method as claimed in claim 1, wherein said flap portion of said first membrane section has a free end portion displaced from the surface of the edge portion of the flat portion of the second adjacent membrane section.

7. The method as claimed in claim 6, wherein the membrane is further formed by rolling said connected water-proof membrane sections in a roll.

* * * * *